US011272784B2

(12) United States Patent
Meusburger et al.

(10) Patent No.: US 11,272,784 B2
(45) Date of Patent: Mar. 15, 2022

(54) DRAWER PULL-OUT GUIDE

(71) Applicant: Julius Blum GmbH, Hoechst (AT)

(72) Inventors: Marc Meusburger, Egg (AT); Lukas Kolhaupt, Hoerbranz (AT); Mathias Leierer, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 159 days.

(21) Appl. No.: 16/779,926

(22) Filed: Feb. 3, 2020

(65) Prior Publication Data

US 2020/0170410 A1 Jun. 4, 2020

Related U.S. Application Data

(63) Continuation of application No. PCT/AT2018/060138, filed on Jul. 6, 2018.

(30) Foreign Application Priority Data

Aug. 17, 2017 (AT) ..... A 50685/2017

(51) Int. Cl.
*A47B 88/45* (2017.01)
*A47B 88/487* (2017.01)
*A47B 88/493* (2017.01)

(52) U.S. Cl.
CPC ..... *A47B 88/45* (2017.01); *A47B 88/487* (2017.01); *A47B 88/493* (2017.01)

(58) Field of Classification Search
CPC ..... A47B 88/45; A47B 88/487; A47B 88/493; A47B 88/447; A47B 2210/007
See application file for complete search history.

(56) References Cited

U.S. PATENT DOCUMENTS 4,892,368 A 1/1990 Goto et al.
5,632,541 A * 5/1997 Uthoff ..... A47B 88/427 312/333

(Continued)

FOREIGN PATENT DOCUMENTS

AT 006 364 9/2003
AT 501 777 1/2012

(Continued)

OTHER PUBLICATIONS

Notice of Allowance dated Jul. 20, 2021 in corresponding Chinese Patent Application No. 2018800531365.

(Continued)

*Primary Examiner* — Hanh V Tran
(74) *Attorney, Agent, or Firm* — Wenderoth, Lind & Ponack, L.L.P.

(57) ABSTRACT

A drawer pull-out guide includes at least two guide rails displaceably supported relative to one another, and at least one running carriage having load-transmitting rolling bodies. The running carriage is displaceably supported between the at least two guide rails, and the guide rails, upon a movement of the at least one running carriage, adopt a predefined relative position to one another, provided that no malposition of the guide rails to one another is present. A compensation device compensates for a malposition of the guide rails. The compensation device includes an actuating device to be actuated by one of the guide rails, and the actuating device compensates for the malposition upon an actuation. A switching device is provided for switching the actuating device of the compensation device out of engagement with the guide rail if the predefined relative position of the guide rails to another is present.

20 Claims, 7 Drawing Sheets

(56) References Cited

U.S. PATENT DOCUMENTS 5,775,788 A * 7/1998 Sasse ..... A47B 88/493 312/334.38
7,185,959 B2 3/2007 Mueller et al.
7,309,115 B2 12/2007 Blum et al.
7,452,040 B1 11/2008 Burgess, III
7,883,162 B2 2/2011 Langguth et al.
8,070,361 B2 12/2011 Schroeder
8,167,388 B2 5/2012 Hämmerle
9,279,280 B1 3/2016 Chen et al.
9,730,515 B2 8/2017 Bachor et al.
10,085,558 B2 10/2018 Klaus
10,362,869 B2 * 7/2019 Gasser ..... A47B 88/41
10,667,608 B2 * 6/2020 Rehage ..... E05F 3/00
10,758,043 B2 * 9/2020 Pohlmann ..... A47B 88/467
2001/0054296 A1 * 12/2001 Kaiser ..... A47B 88/45 62/373
2003/0067257 A1 * 4/2003 Gasser ..... A47B 88/467 312/331
2004/0017139 A1 1/2004 Mueller et al.
2005/0174021 A1 8/2005 Blum et al.
2006/0091770 A1 * 5/2006 Ritter ..... A47B 88/493 312/334.13
2006/0186773 A1 * 8/2006 Lam ..... A47B 88/493 312/334.8
2008/0278048 A1 11/2008 Burgess, III
2009/0096337 A1 4/2009 Langguth et al.
2009/0232426 A1 9/2009 Hammerle
2009/0285513 A1 11/2009 Schroeder
2010/0027923 A1 * 2/2010 Bonat ..... A47B 88/493 384/55
2010/0327719 A1 * 12/2010 Koenig ..... A47B 88/463 312/333
2011/0200278 A1 * 8/2011 Radusin ..... A47B 88/467 384/49
2012/0014627 A1 * 1/2012 Rehage ..... A47B 88/493 384/49
2012/0051675 A1 * 3/2012 Huang ..... A47B 88/493 384/20
2013/0069515 A1 * 3/2013 Bonat ..... A47B 88/483 312/334.8
2013/0119843 A1 * 5/2013 Breisacher ..... A47B 88/467 312/334.47
2013/0127319 A1 * 5/2013 Breisacher ..... A47B 88/493 312/334.23
2013/0270987 A1 10/2013 Kelly
2014/0152165 A1 * 6/2014 Zimmermann ..... E05B 65/46 312/333
2014/0241651 A1 * 8/2014 Greussing ..... A47B 88/487 384/19
2015/0159415 A1 * 6/2015 Rehage ..... A47B 88/493 16/95 R
2015/0289648 A1 * 10/2015 Bachor ..... A47B 88/931 312/334.46
2015/0366346 A1 * 12/2015 Raid ..... A47B 88/493 312/334.44
2016/0060934 A1 3/2016 Chen et al.
2016/0128472 A1 * 5/2016 Ng ..... A47B 88/493 384/18
2016/0128475 A1 * 5/2016 Jah ..... A47B 88/443 248/241
2016/0146533 A1 * 5/2016 Jung ..... A47B 88/45 312/405
2016/0157607 A1 * 6/2016 Uffner ..... A47B 88/43 312/334.45
2016/0319582 A1 * 11/2016 Grabher ..... A47B 88/487
2016/0324318 A1 * 11/2016 Langguth ..... F16C 29/04
2017/0105525 A1 4/2017 Klaus
2017/0135481 A1 * 5/2017 Chen ..... A47B 88/463
2017/0135482 A1 * 5/2017 Chen ..... F16C 29/045
2017/0172301 A1 * 6/2017 Janzen ..... A47B 88/497

FOREIGN PATENT DOCUMENTS

CN 2282358 5/1998
CN 2838402 11/2006
CN 101426403 5/2009
CN 101528085 9/2009
CN 203369601 1/2014
CN 104507360 4/2015
CN 106102518 11/2016
DE 20 2004 007 227 8/2005
DE 10 2005 017 417 12/2005
EP 1 374 734 1/2004
EP 3 056 116 8/2016
EP 3 058 847 8/2016
JP 2004-89710 3/2004
JP 2004089710 A * 3/2004 ..... A47B 88/493
KR 10-2015-0134190 12/2015
TW 201615129 5/2016
WO 2008/135492 11/2008
WO 2009/143096 11/2009
WO 2014/056763 4/2014

OTHER PUBLICATIONS

International Search Report dated Aug. 20, 2018 in International (PCT) Application No. PCT/AT2018/060138.
Search Report dated Dec. 29, 2020 in corresponding Chinese Patent Application No. 201880053136.5.

* cited by examiner

DRAWER PULL-OUT GUIDE

BACKGROUND OF THE INVENTION

The present invention relates to a drawer pull-out guide, comprising at least two guide rails displaceably supported relative to one another, and at least one running carriage having load-transmitting rolling bodies. The running carriage is displaceably supported between the at least two guide rails, and the guide rails, upon a movement of the at least one running carriage, adopt a predefined relative position to one another, provided that no malposition (misalignment) of the guide rails to one another is present. The drawer pull-out guide also comprises a compensation device for compensating for a malposition, deviating from the predefined relative position, of the guide rails to one another, and the compensation device includes an actuating device configured to be actuated by one of the guide rails, and the actuating device compensates for the malposition upon an actuation.

The invention further concerns a drawer comprising at least one drawer pull-out guide of the type to be described.

Malpositions (misalignments) in connection with drawer pull-out guides denote both incorrect rail positions and incorrect positions of the running carriages, which could lead to the drawer staying open during normal use. An incorrect rail position occurs, for example, if the drawer rail deviates from a synchronous movement relative to the displaceable central rail, whereby the relative position of the rails in relation to each other is not correct. In contrast, a malposition of the running carriage denotes incorrect positioning of the running carriage which builds up over an opening and closing movement and which is determined by the built-up difference in relation to the correct initial position. A malposition of the running carriage can build up, in particular, due to slippage or due to elasticity in the rolling or running system during the operating movement. As from a given number of movements, the running carriage can depart so far from its target position that the running carriage hits against an end stop in the rail system, even before the drawer is completely closed. Moreover, drawer pull-out guides are frequently equipped with a retraction device and with a damper for dampening the retraction path of the drawer over the last closing region until reaching the fully closed position. Those dampers, however, reduce the closing dynamics of the drawer in such a way that a malposition, which has occurred during the movement of the drawer, can no longer be compensated due to the lack of kinetic energy. Upon each additional movement, in which the drawer is not completely opened, the drawer remains stopped in an open position due to the malposition. This can be visually disturbing and also involves the danger that the drawer can collide with persons or objects.

EP 1 374 734 A1 discloses a drawer pull-out guide having a compensation device for compensating for a synchronous running error of the guide rails. A compensating lever having two lever arms is arranged on the central rail, a first lever arm being configured to cooperate with the drawer rail and a second lever arm being configured to cooperate with the carcass rail at the end of the closing movement. The compensation device is thereby configured as a non-continuous synchronization, but rather as a so-called pseudo-synchronization or self-adjusting of a depth gap formed between the rear side of the drawer front panel and the front face of the furniture carcass. The compensation device is thereby configured such that the mentioned depth gap is corrected to a certain value upon closing the drawer. A drawback is the fact that the compensation lever cooperates with the drawer rail and with the carcass rail upon each closing movement. Besides disturbing noises, the friction is also increased and the drawer must be moved into the fully closed end position with an increased effort. Due to the occurring friction, the spring force of the retraction device is also to be larger dimensioned, so that the drawer can be reliably retracted into the closed end position.

SUMMARY OF THE INVENTION

It is an object of the present invention to propose a drawer pull-out guide of the type mentioned in the introductory part, thereby avoiding the drawbacks as discussed above.

According to the invention, a switching device is provided for switching the actuating device of the compensation device out of engagement with the guide rail, if the predefined relative position of the guide rails to another is present.

In other words, the actuating device of the compensation device can only be actuated by a movement of a guide rail if, in fact, a malposition (misalignment) of the guide rails to one another is present. On the contrary, if there is no malposition present, the guide rails can be displaced relative to one another without interference from the compensation device.

Thereby, the actuating device of the compensation device includes an actuating element movably-mounted on a guide rail, the actuating element being configured, for compensating for the malposition, to be actuated by an abutment portion arranged or formed on the other guide rail, and wherein the actuating element, if the predefined relative position is present, is out of engagement with the abutment portion.

The abutment portion for actuating the actuating element can thereby be arranged on a front-end region of a guide rail. Thereby, it can be provided that the abutment portion protrudes transversely from the guide rail and, preferably, the abutment portion protrudes downwardly from a guide rail in a mounted position.

The switching device can include a movably-mounted switch element which is connected to the actuating element in a movement-coupled manner, for example by at least one hinge axis member. The switch element can have a first switching position and at least one second switching position. In the first switching position of the switch element, the actuating element—if the malposition of the guide rails to one another is present—is located in a first position in which the actuating element can be releasably coupled to the abutment portion. In the second switching position of the switch element, the actuating element—if the predetermined relative position of the guide rails to one another is present—is located in a second position in which the actuating element is out of engagement with the abutment portion.

For controlling a movement of the switch element, a blocking device can be provided. The blocking device is arranged or formed on one of the guide rails and blocks a movement of the switch element—if the malposition of the guide rails to one another is present—from the first switching position into the second switching position. Thereby, it can be provided that the switch element, in the first switching position—if the malposition of the guide rails to one another is present—bears against the blocking device, and the actuating device of the compensation device can be actuated by a guide rail. In the second switching position of the switch element—if the predetermined relative position of the guide rails to one another is present—the switch element can be located in an expanded space, so that the actuating device of the compensation device is out of engagement with the guide rail, and, therefore, cannot be actuated by the guide rail.

According to an embodiment, the compensation of the malposition is effected upon an opening movement of the drawer pull-out guide. This has the particular advantage that upon the opening movement of a guide rail, a manual force has anyway to be applied to the drawer and that a possible correction of the malposition is practically not noticed by an operator.

BRIEF DESCRIPTION OF THE DRAWINGS

Further details and advantages of the invention result from the following description of figures, in which.

DETAILED DESCRIPTION OF THE INVENTION

Figure 1:
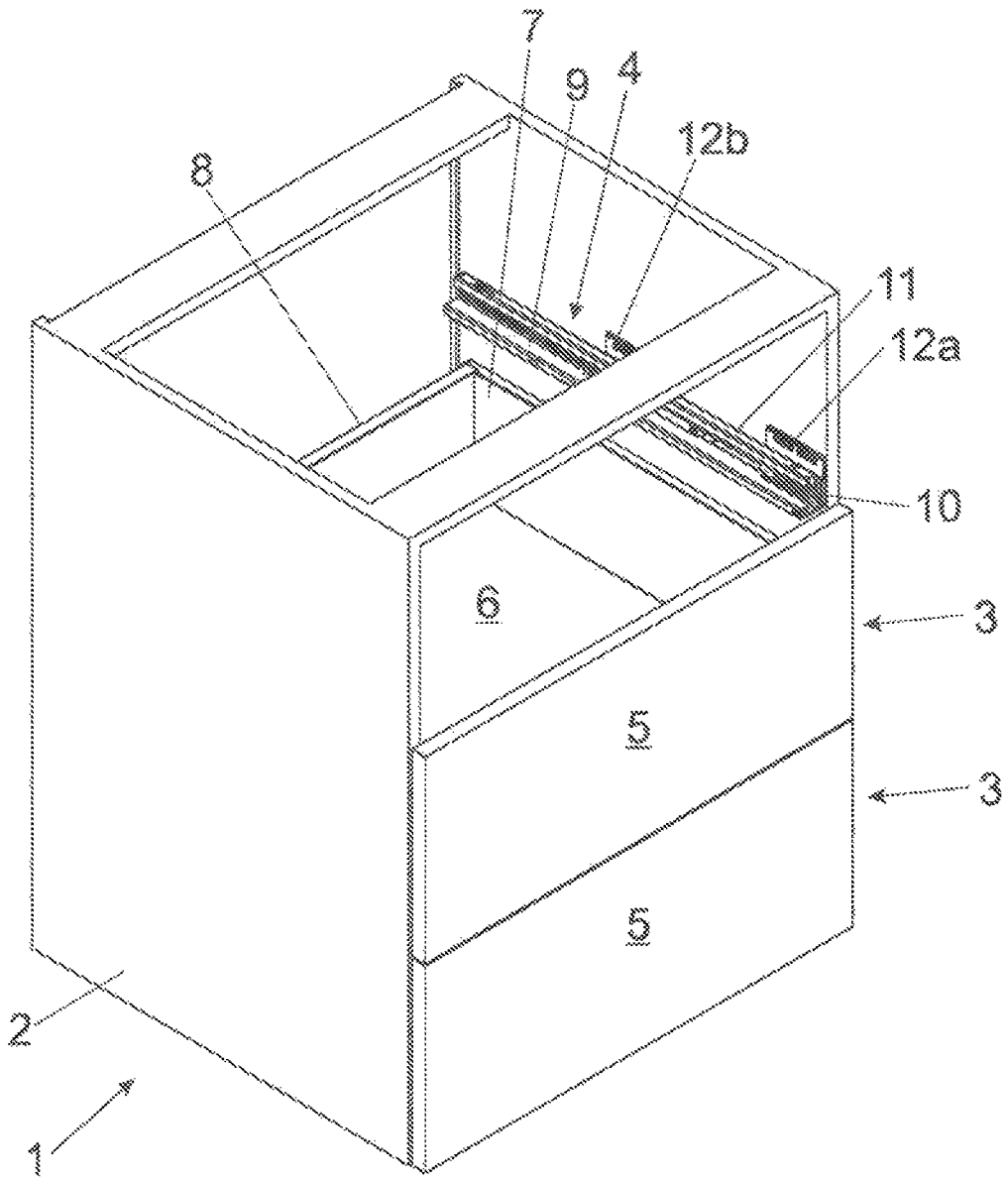
FIG. 1 is a perspective view of an item of furniture having a furniture carcass and drawers displaceably supported relative thereto.

FIG. 1 shows an item of furniture 1 having a cupboard-shaped furniture carcass 2, and drawers 3 are displaceably supported relative to the furniture carcass 2 by drawer pull-out guides 4. Each of the drawers 3 includes a front panel 5, a drawer bottom 6, sidewalls 7 and a rear wall 8. In the shown embodiment, each of the drawer pull-out guides 4 includes a first guide rail 9 configured to be fixed to the furniture carcass 2 by fastening portions 12*a*, 12*b*, and a third guide rail 11 to be connected to the drawer 3, the third guide rail 11 being displaceable relative to the first guide rail 9. The drawer pull-out guide further 4 includes a second guide rail 10 which, in order for a full-extension of the drawer 3 to be realized, is displaceably supported between the first guide rail 9 and the third guide rail 11. However, it is also possible that the drawer pull-out guide 4 has only two guide rails 9, 10 configured to be displaceable relative to one another.

Figure 2:
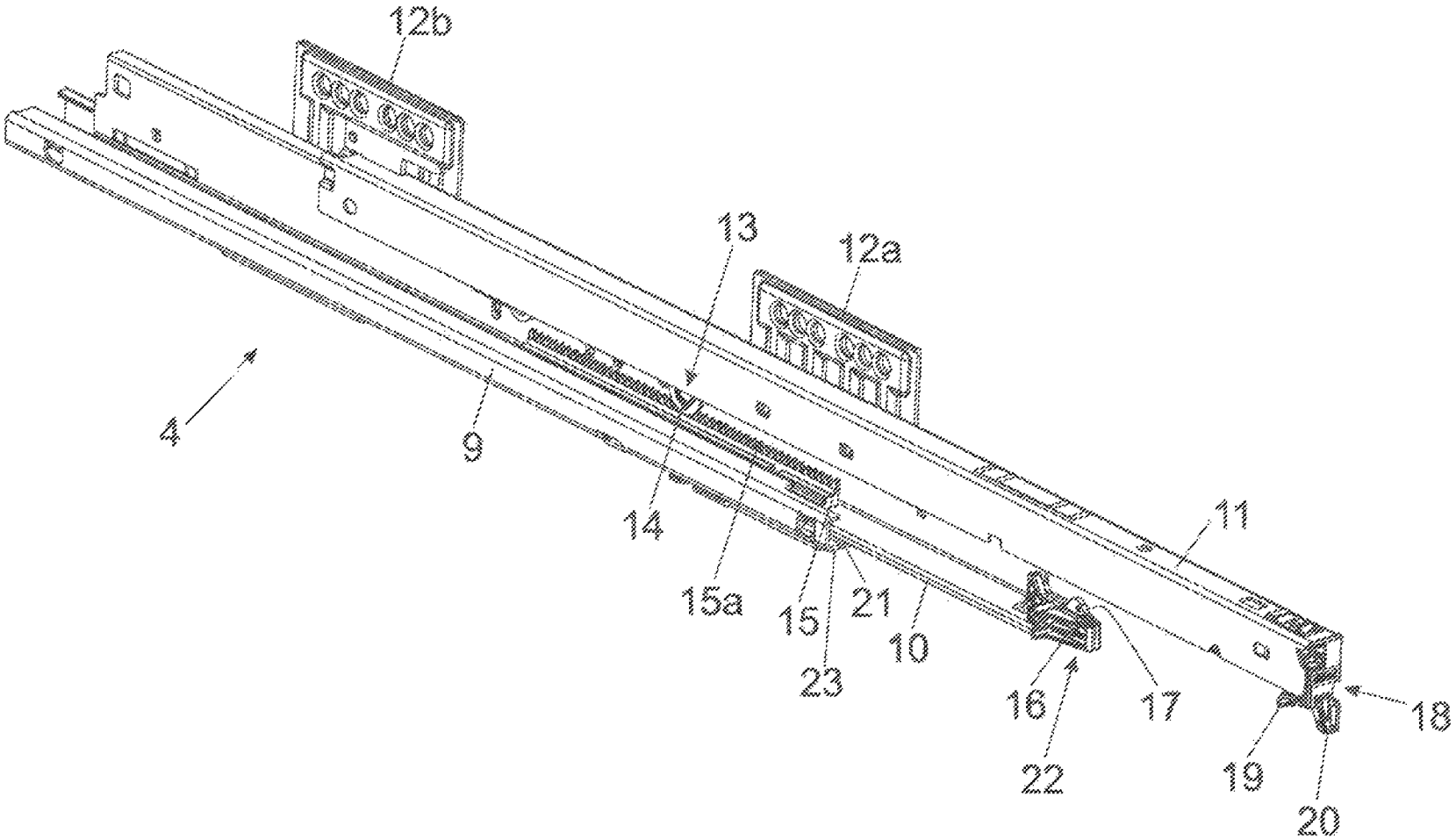
FIG. 2 shows a drawer pull-out guide in a perspective view.

FIG. 2 shows a perspective view of a drawer pull-out guide 4 with the first guide rail 9 to be fixed to the furniture carcass 2 and the third guide rail 11 to be fixed to the drawer 3. The second rail 10 is displaceably supported between the first guide rail 9 and the third guide rail 11. By a synchronization device 13, a movement of a running carriage 15 can be controlled, the running carriage 15 being displaceably arranged between the guide rails 9, 10, 11. In the shown embodiment, the synchronization device 13 includes a pinion 14 rotatably arranged on the second guide rail 10. The pinion 14, one the one hand, cooperates with the first running carriage 15 being arranged between the first guide rail 9 and the second guide rail 10. On the other hand, the pinion 14 cooperates with a second running carriage 28 (not shown here, see FIG. 4*a*) displaceably arranged between the second guide rail 10 and the third guide rail 11. The pinion 14 cooperates with the running carriages 15, 28 via tooth arrangements 15*a*, 28*a* of the first and second running carriage 15, 28. A functional unit 18 having an end stop 20 is arranged on the front-end of the third guide rail 11, the end stop 20 abutting against a counterstop 21 of the first guide rail 9 in the closed position of the drawer pull-out guide 4 so as to limit an insertion movement of the third guide rail 11.

Moreover, a compensation device 22 is provided, by which a malposition (misalignment) of the guide rails 9, 10, 11, deviating from a predetermined relative position of the guide rails 9, 10, 11 to one another, can be compensated for. In the shown embodiment, the compensation device 22 includes an abutment portion 19 protruding transversely from the third guide rail 11 in a downward direction, and an actuating device 17 arranged on the second guide rail 10. The actuating device 17 is configured to be actuated by the abutment portion 19, if a malposition (misalignment) of the guide rails 9, 10, 11 is present.

Figure 3A:
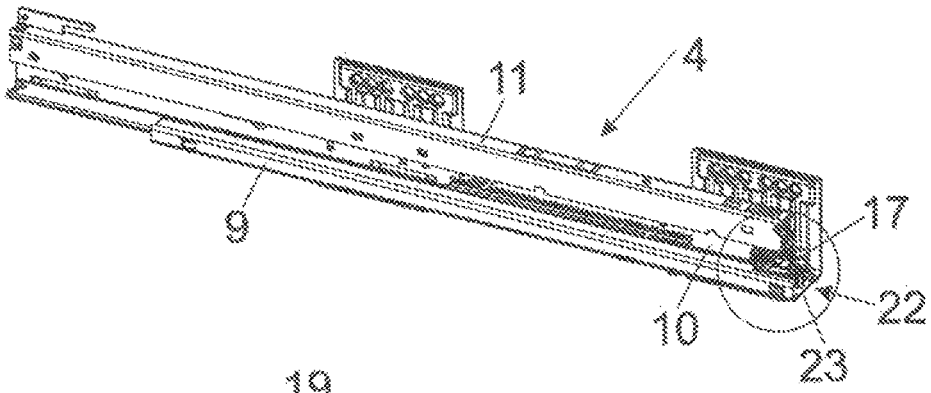
FIG. 3*a*-3*d* show the drawer pull-out guide in different views and enlarged detail views thereof.

FIG. 3*a* shows the drawer pull-out guide 4 located in the closed position, with the first, second and third guide rail 9, 10, 11 in a perspective view.

Figure 3B:
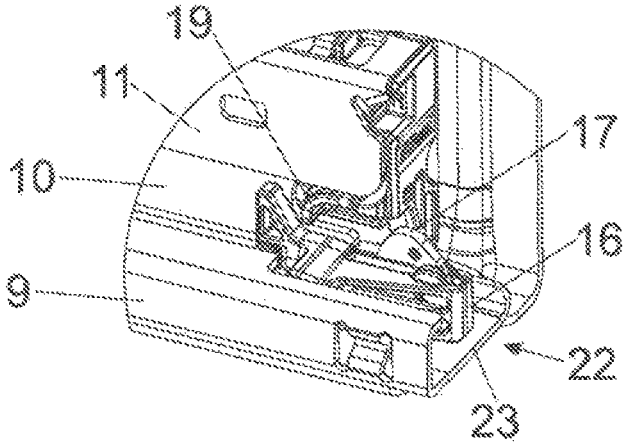

FIG. 3*b* shows the encircled region of FIG. 3*a* in an enlarged view. A bearing portion 16 with the actuating device 17 is arranged on the front end of the second guide rail 10, the actuating device 17 being configured to be actuated by the abutment portion 19 arranged on the third guide rail 11, if a malposition of the guide rails 9, 10, 11 is present.

Figure 3C:
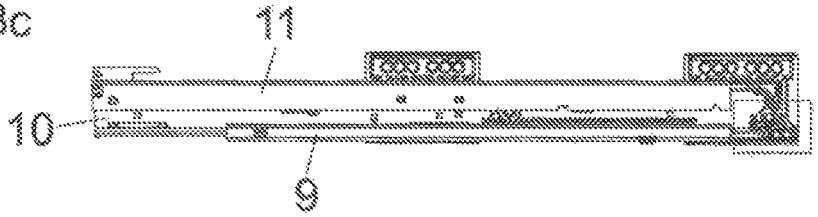
Figure 3D:
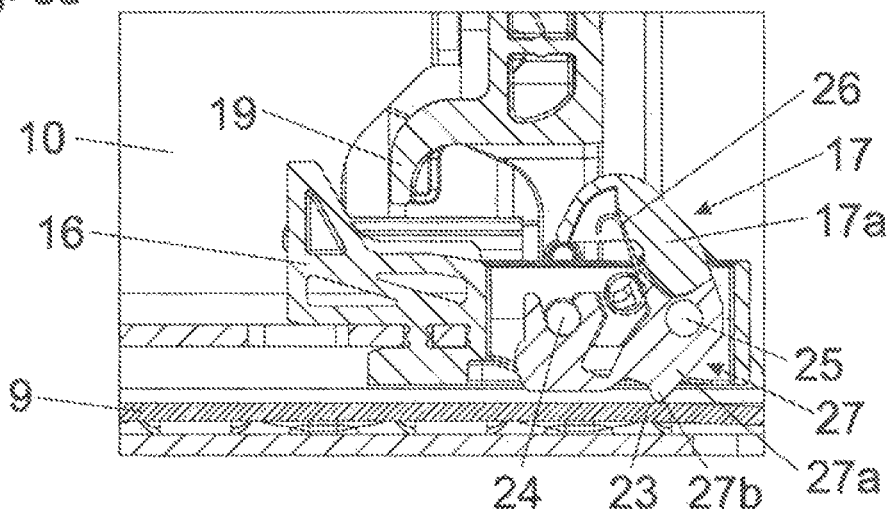

FIG. 3*c* shows a side view of the drawer pull-out guide 4. FIG. 3*d* shows the framed front region of FIG. 3*c* in an enlarged view. The actuating device 17 includes a movably-mounted, preferably pivotally-mounted, actuating element 17*a* which, upon a malposition, can be releasably coupled to the abutment portion 19. For example, the actuating element 17*a* can have a curved-shaped peripheral surface along which the abutment portion 19 can be moved at least over a region. By a switching device 27, the actuating device 17 can be switched out of engagement with the third guide rail 11, preferably with the abutment portion 19, if the (correct) predefined relative position of the guide rails 9, 10, 11 to one another is present. The switching device 27 includes a movable, preferably about the axis 24 pivotally supported, switch element 27*a* which is connected to the actuating element 17*a* in a movement-coupled manner. In the shown embodiment, the switch element 27*a* and the actuating element 17*a* are pivotally connected to one another by at least one moving hinge axis member 25. By a force storage member 26, the actuating element 17*a* and the switch element 27*a* are pre-stressed relative to one another such that the actuating element 17*a* and the switch element 27*a* are pressed apart from one another about the hinge axis member 25 by a force of the force storage member 26. The switch element 27*a* is pivotally mounted about the axis 24 and includes a protrusion 27*b* which, in the closed position of the second guide rail 10, bears against a blocking device 23, preferably a limb, of the first guide rail 9. By the blocking device 23, a movement of the switch element 27*a*—if a malposition of the guide rails 9, 10, 11 to one another is present—from the first switching position into the second switching position is prevented. In FIGS. 3*a*-3*d*, the guide rails 9, 10, 11 adopt a correct, predefined relative position to one another.

Figure 4A:
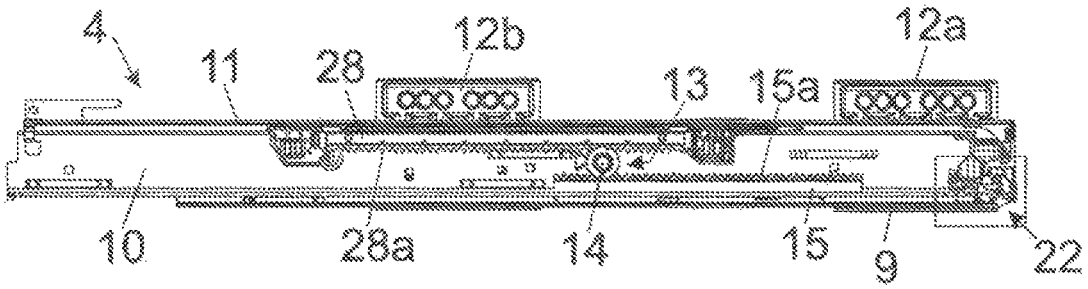
FIG. 4*a*-4*c* show the drawer pull-out guide in a cross-sectional view and two enlarged views of an extension movement of the guide rails having a correct, predetermined relative position to one another.

FIG. 4*a* shows the drawer pull-out guide 4 in a cross-sectional view. A first running carriage 15 having load-transmitting first rolling bodies 36 (see FIG. 7*a*) is arranged between the first guide rail 9 and the second guide rail 10. A second running carriage 28 having second rolling bodies 37 is displaceably arranged between the second guide rail 10 and the third guide rail 11. By a synchronization device 13, a motion sequence of the two running carriages 15, 28 to one another can be controlled. The synchronization device 13 includes a pinion 14 rotationally mounted to the second guide rail 10, the pinion 14 meshing with a first tooth arrangement 15*a* of the (lower) first running carriage 15 and meshing with a second tooth arrangement 28*a* of the (upper) second running carriage 28. In FIG. 4*a*, the third guide rail 11 is located in a slight open position.

Figure 4B:
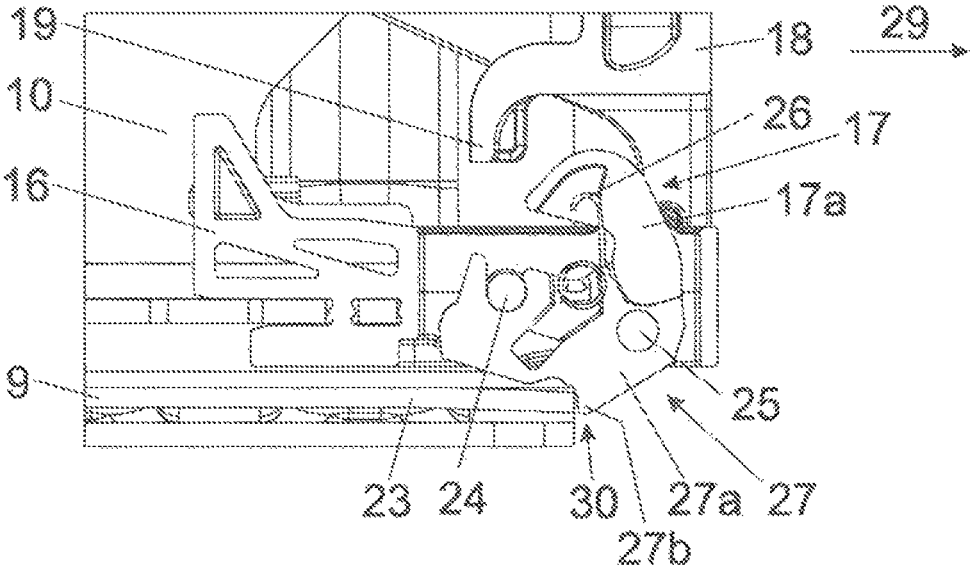
Figure 4C:
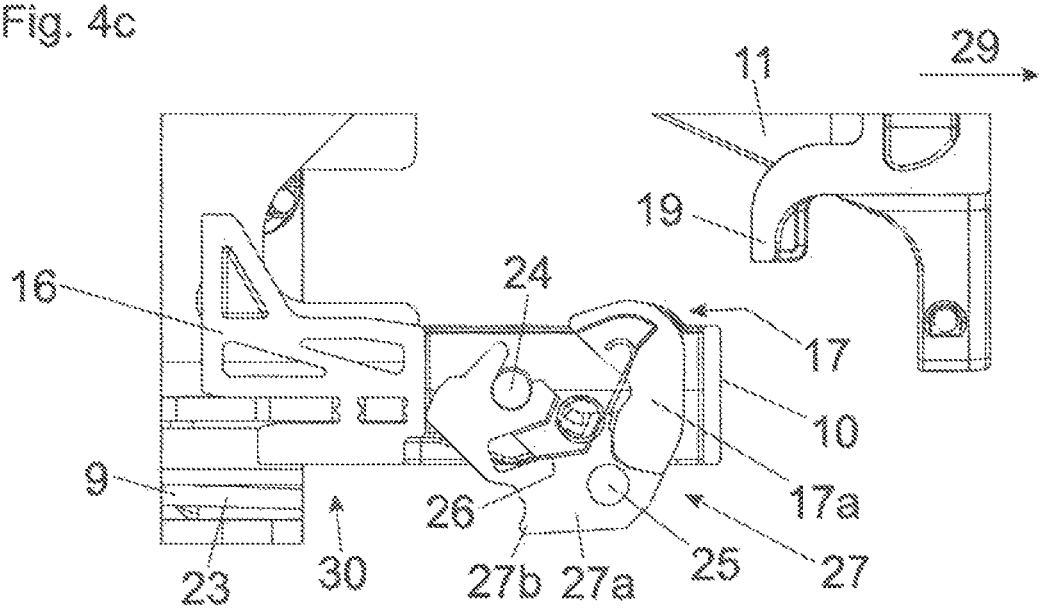

FIG. 4*b* shows the framed region of FIG. 4*a*, i.e. the front region of the drawer pull-out guide 4 in an enlarged view, in which the compensation device 22 is shown in greater detail. In the shown FIGS. 4*a*-4*c*, the guide rails 9, 10, 11 are located in a predefined, correct relative position to one another. If the third guide rail 11 is now moved from the closed position, shown in FIG. 3*d*, in the extension direction 29, the switch element 27*a* reaches into an expanded space 30, so that the switch element 27*a*, together with the actuating element 17*a*, can be tilted about the axis 24 in a clockwise direction such that the abutment portion 19 arranged on the third guide rail 11 can further be moved in the direction of the open position without interference from the actuating device 17. The expanded space 30 can be configured either as a recess in the first guide rail 9, or—as shown in the figure—as a free space located in front of the first guide rail 9 in the mounted position, so that the protrusion 27*b* of the switch element 27*a* moves, so to say, into the void. Upon a movement of the third guide rail 11 in a direction opposite the extension direction 29, the third guide rail 11 can be again moved into the closed position without interference from the actuating device 17, and the abutment portion 19 can be moved over the actuating element 17*a*, possibly against a force of the force storage member 26.

Figure 5A:
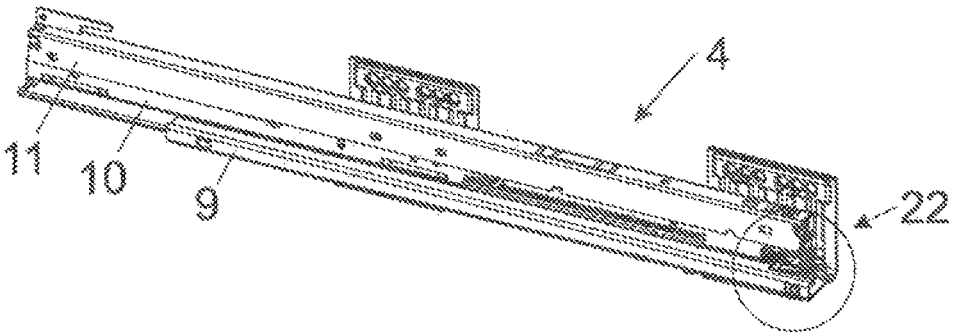
FIG. 5*a*-5*d* show the drawer pull-out guide in a perspective view, in a side view and enlarged detail views thereof.

FIG. 5*a* shows the drawer pull-out guide 4 in a perspective view, in which the guide rails 9, 10, 11 for example due to a slippage occurring between the running carriages 15, 28 and the guide rails 9, 10, 11 adopt a malposition to one another (i.e., are misaligned with respect to each other), the malposition deviating from the predefined relative position. This can lead, for example, to the second guide rail 10 being positioned too far behind in relation to the first guide rail 9, i.e. the first and second guide rails 9, 10 bear against one another via a contact location 31 (FIG. 5*b*) and, therefore, a malposition to be corrected is present.

Figure 5B:
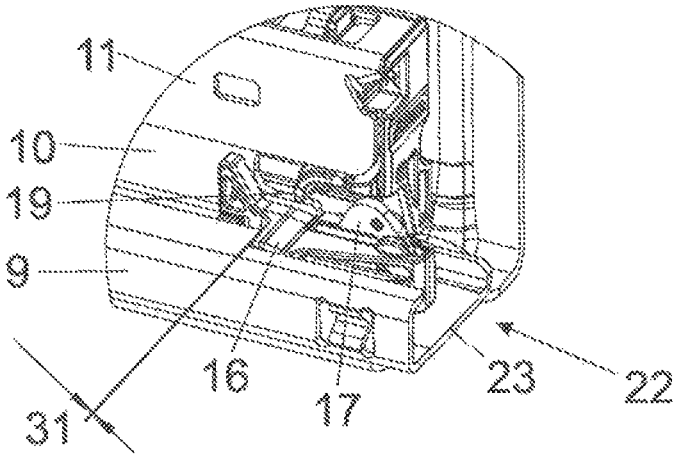
Figure 5C:
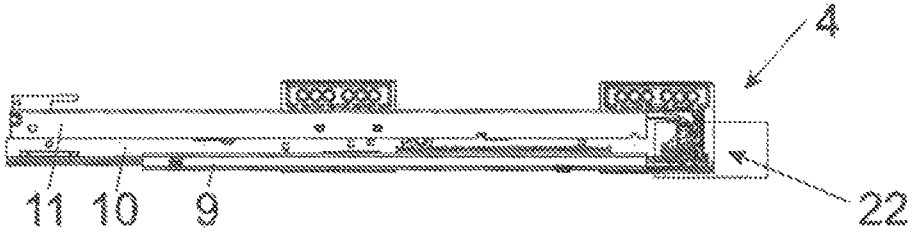
Figure 5D:
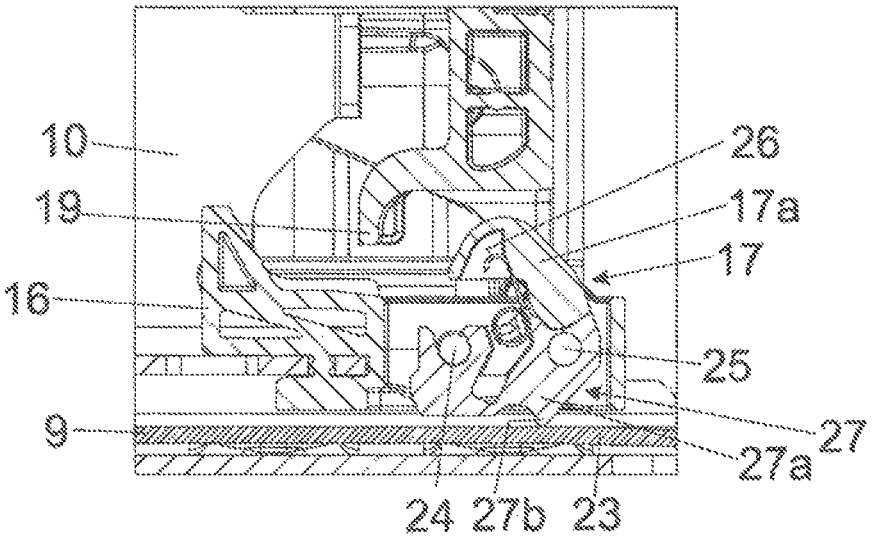
Figure 6A:
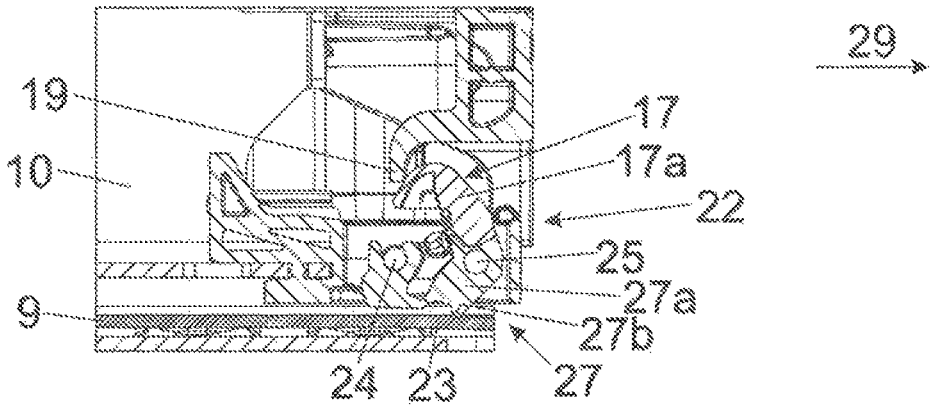
FIG. 6*a*-6*d* show a temporal sequence of correcting a malposition of the guide rails in enlarged detail views.
Figure 6B:
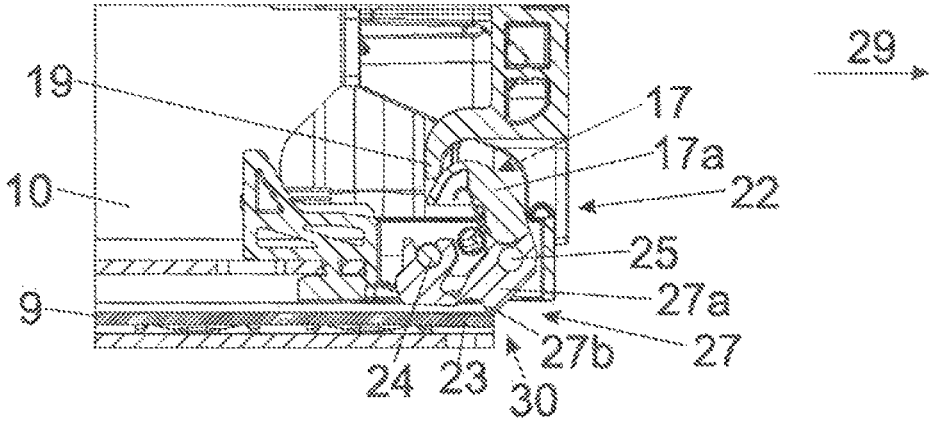
Figure 6C:
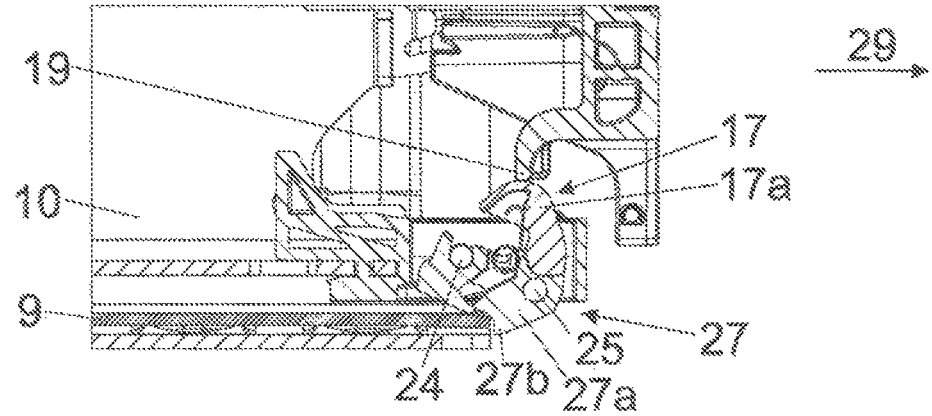
Figure 6D:
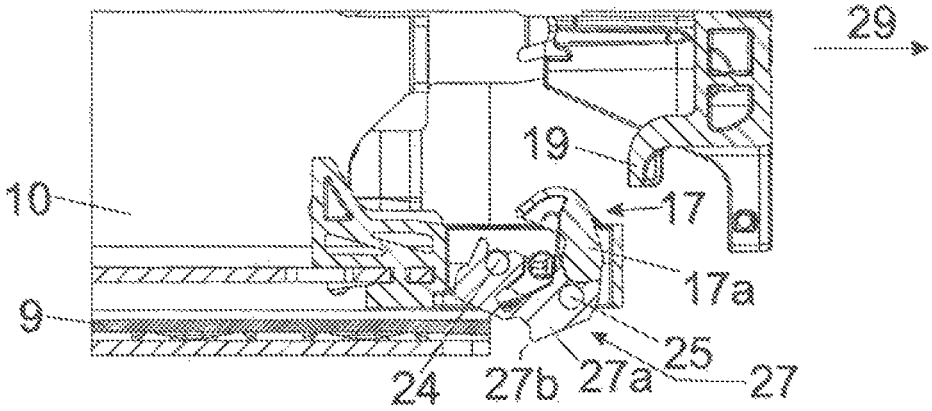

FIG. 5*b* shows the encircled region of FIG. 5*a* in an enlarged view. FIG. 5*c* shows a side view of the drawer pull-out guide 4. FIG. 5*d* shows the framed region of FIG. 5*c*, i.e. the front-end of the drawer pull-out guide 4 in an enlarged view. In the fully closed position, the protrusion 27*b* of the switch element 27*a* bears against the blocking device 23 of the first guide rail 9. The foremost region of the limb of the first guide rail 9 can extend inclinedly to the front in a downward direction, whereby the friction can be reduced and the tilting behavior of the switch element 27*a* can be improved.

FIGS. 6*a*-6*d* show a temporal sequence of the opening movement of the third guide rail 11 in the extension direction 29. Starting from FIG. 5*d*, in which a malposition of the second guide rail 10 in relation to the first guide rail 9 is present, the actuating element 17*a* of the actuating device 17 can be contacted by the abutment portion 19 of the third guide rail 11 (see FIG. 6*a*). The protrusion 27*b* of the switch element 27*a* thereby bears against the blocking device 23 of the first guide rail 9, and the blocking device 23 prevents a movement (rotation) of the switch element 27*a* into a second, deactivated switching position of the switch element 27*a*. Accordingly, the switch element 27*a* cannot be rotated/tilted) about the axis 24. The third guide rail 11 is thus coupled to the second guide rail 10 via the abutment portion 19 and via the actuating element 17*a*. Because of the fact that the third guide rail 11 is moved by the synchronization device 13 (see FIG. 2) with a higher, preferably about the double, speed than the second guide rail 10, the second guide rail 10 is temporarily coupled to the higher speed of the third guide rail 11. Accordingly, the second guide rail 10 and the third guide rail 11 are moved with a same speed relative to the first guide rail 9 upon a compensation of a malposition, and the second guide rail 10 is dragged over the rolling bodies 36 of the first running carriage 15 (see FIG. 6*b*, FIG. 6*c*). The protrusion 27*b* of the switch element 27*a*, after the malposition has been corrected, can again be moved over the front end of the first guide rail 9 (or expanded space 30), so that the switch element 27*a* can be tilted about the axis 24. As a result, the coupling between the actuating element 17*a* and the abutment portion 19 of the third guide rail 11 can be released. Thus, in FIG. 6*d*, the second guide rail 10 has again reached its target position relative to the first guide rail 9.

Figure 7A:
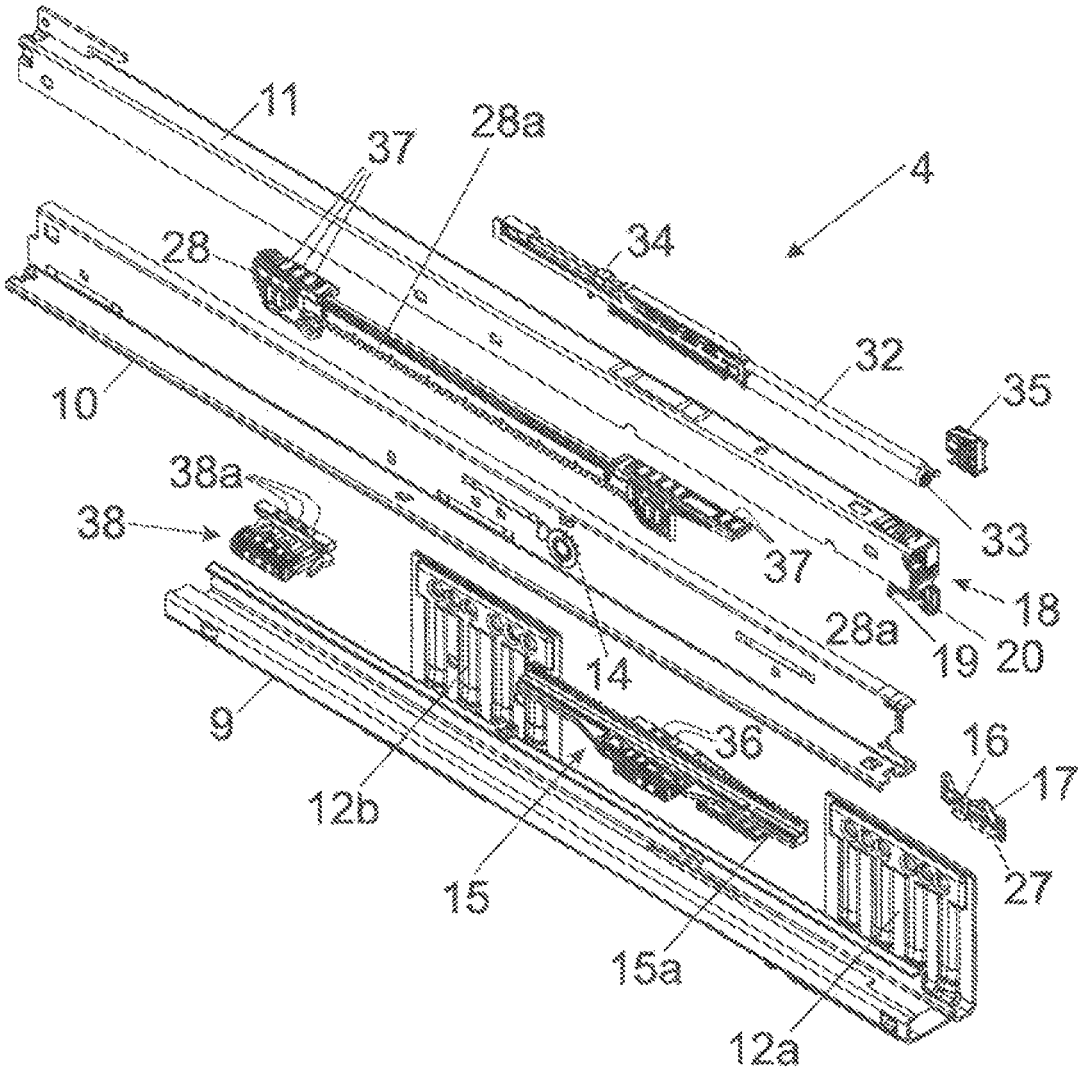
FIG. 7*a*, 7*b* show the drawer pull-out guide and the compensation device in exploded views.

FIG. 7*a* shows the drawer pull-out guide 4 in an exploded view. The first guide rail 9 is to be fixed to a furniture carcass 2, and the third guide rail 11 is to be fixed to the drawer 3. The second guide rail 10 is displaceably supported between the first guide rail 9 and the third guide rail 11. A first running carriage 15 is displaceably arranged between the first guide rail 9 and the second guide rail 10, the first running carriage 15 having a plurality of rolling bodies 36 spaced from each other in the longitudinal direction. A further running carriage 38, separate from the first running carriage 15, is also arranged between the first guide rail 9 and the second guide rail 10, the further running carriage 38 having rolling bodies 38*a*. A second running carriage 28 is arranged between the second guide rail 10 and the third guide rail 11, the second running carriage 28 having a plurality of rolling bodies 37 spaced from each other in a longitudinal direction. By a pinion 14 rotatably arranged on the second guide rail 10, the movements of the running carriages 15, 28 can be controlled to one another, the pinion 14 meshing with tooth arrangements 15*a*, 28*a* of the first and second running carriage 15, 28. A bearing portion 16 with the actuating device 17 and with the switching device 27 is to be fixed to the front-end region of the second guide rail 10. On the front-end region of the third guide rail 11, the functional unit 18 with the end stop 20 and with the abutment portion 19 is arranged. By a displaceable entrainment member 34 pre-stressed by a spring device 32, the third guide rail 11 can be retracted into the closed end position at the end of the closing movement. By a damping device 33, preferably having a piston-cylinder-unit, the spring-assisted retraction movement into the closed end position can be decelerated. The spring device 32 and the damping device 33 are fixed to the third guide rail 11 by a holding device 35.

Figure 7B:
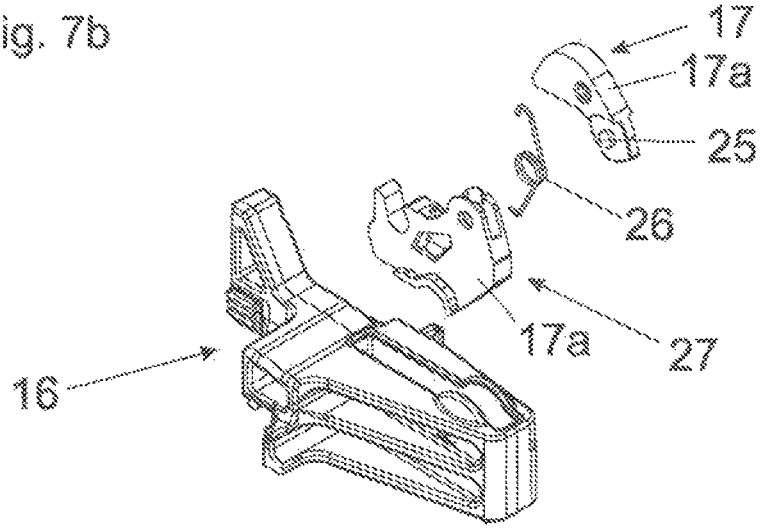

FIG. 7*b* shows the actuating device 17 arranged on the bearing portion 16 and the switching device 27 in an exploded view. The actuating element 17*a* and the switch element 27*a* can be connected to one another by a hinge axis member 25. By a force storage member 26, for example in the form of a leg spring, the actuating element 17*a* and the switch element 27*a* are pre-stressed relative to one another. In this way, the switch element 27*a* can be pressed against the blocking device 23 by a force of the force storage member 26, whereby a defined switching behavior of the switch element 27*a* between the two switching position can be provided. On the other hand, the actuating element 17*a*, upon an insertion movement of the third guide rail 11, can be overrun against a force of the force storage member 26, so that the third guide rail 11 can be moved into the closed position without substantial impediment.

The actuating device 17 can be arranged, in contrast to the figures shown, not only on the second guide rail 10, but also on the other guide rails 9, 11 and on different positions along their longitudinal direction. For example, it is thus possible to arrange the actuating device 17 on the third guide rail 11 for correcting a malposition, and the abutment member 19 on the second rail 10 in order for the actuating device 17 to be actuated.

The invention claimed is:

1. A drawer pull-out guide, comprising:

at least two guide rails displaceably supported relative to one another;

a running carriage having load-transmitting rolling bodies, the running carriage being displaceably supported between the at least two guide rails such that the at least two guide rails, upon a movement of the running carriage, adopt a predefined relative position to one another, provided there is no misalignment of the at least two guide rails to one another;

a compensation device for compensating for a misalignment deviating from the predefined relative position of the at least two guide rails to one another, the compensation device including an actuating device configured to be actuated by one of the at least two guide rails, and the actuating device being configured to compensate for the misalignment upon an actuation; and a switching device for switching the actuating device of the compensation device out of engagement with the one of the at least two guide rails if the predefined relative position of the at least two guide rails to one another is present.

2. The drawer pull-out guide according to claim 1, wherein the actuating device of the compensation device includes an actuating element movably mounted on a first one of the at least two guide rails, the actuating element being configured to be actuated by an abutment portion arranged or formed on a second one of the at least two guide rails for compensating for the misalignment, and the actuating element being configured to be out of engagement with the abutment portion if the predefined relative position is present.

3. The drawer pull-out guide according to claim 2, wherein the abutment portion protrudes transversely from a front-end region of the second one of the at least two guide rails.

4. The drawer pull-out guide according to claim 1, wherein the switching device includes a movably-mounted switch element connected to the actuating element of the compensation device in a movement-coupled manner.

5. The drawer pull-out guide according to claim 4, wherein the switch element is pivotally connected to the actuating element by a hinge axis member.

6. The drawer pull-out guide according to claim 4, wherein the switch element has a first switching position and a second switching position, wherein the actuating element is configured such that, in the first switching position of the switch element, the actuating element is located in a first position in which the actuating element is releasably coupled to the abutment portion if the at least two guide rails are misaligned to one another, and the actuating element is further configured such that, in the second switching position of the switch element, the actuating element is located in a second switching position in which the actuating element is out of engagement from the abutment portion if the predefined relative position of the at least two guide rails to one another is present.

7. The drawer pull-out guide according to claim 6, wherein one of the at least two guide rails includes a blocking device configured to block a movement of the switch element from the first switching position into the second switching position if the at least two guide rails are misaligned to one another.

8. The drawer pull-out guide according to claim 7, wherein the blocking device is a limb of one of the at least two guide rails.

9. The drawer pull-out guide according to claim 7, wherein the blocking device is arranged on an end region of one of the at least two guide rails.

10. The drawer pull-out guide according to claim 4, further comprising a force storage member pre-stressing the actuating element of the compensation device and the switch element of the switching device relative to one another.

11. The drawer pull-out guide according to claim 1, further comprising a synchronization device for controlling a synchronous movement of the running carriage.

12. The drawer pull-out guide according to claim 1, wherein the at least two guide rails includes a first guide rail, a second guide rail, and a third guide rail to be fixed to the drawer, the third guide rail being configured so as to be displaceable relative to the first guide rail and the second guide rail.

13. The drawer pull-out guide according to claim 12, wherein the compensation device is configured to move the second guide rail and the third guide rail with a same speed relative to the first guide rail upon a misalignment of the at least two guide rails.

14. The drawer pull-out guide according to claim 12, further comprising a second running carriage having load-transmitting rolling bodies, the second running carriage being displaceably arranged between the second guide rail and the third guide rail.

15. The drawer pull-out guide according to claim 11, wherein the running carriage is a first running carriage being displaceably arranged between a first guide rail and a second guide rail of the at least two guide rails, the drawer pull-out guide further comprising a second running carriage having load-transmitting rolling bodies, the second running carriage being displaceably arranged between the second guide rail and a third guide rail of the at least two guide rails, wherein the synchronization device includes a rotatably mounted pinion, the pinion cooperating with the first running carriage and with the second running carriage.

16. The drawer pull-out guide according to claim 1, wherein the compensation device is configured to compensate for a misalignment deviating from the predefined relative position upon an opening movement of the drawer pull-out guide.

17. A drawer comprising the drawer pull-out guide according to claim 1 for moving the drawer relative to a furniture carcass.

18. The drawer pull-out guide according to claim 9, wherein the blocking device is arranged on a front end region of the one of the at least two guide rails.

19. The drawer pull-out guide according to claim 15, wherein the pinion is mounted on the second guide rail.

20. The drawer pull-out guide according to claim 1, wherein the switching device is configured to switch the actuating device of the compensation device out of engagement with all of the at least two guide rails if the predefined relative position of the at least two guide rails to one another is present.

* * * * *